US006148696A

United States Patent [19]

Chiang

[11] Patent Number: 6,148,696

[45] Date of Patent: Nov. 21, 2000

[54] RATCHET SCREW DRIVER

[76] Inventor: Shu Chi Chiang, No. 33-12, Lane 320, Sec. 1, Sa Tien Road, Da Du Hsiang, Taichung Hsien, Taiwan

[21] Appl. No.: 09/323,383

[22] Filed: Jun. 1, 1999

[51] Int. Cl.[7] ..... B25B 13/46

[52] U.S. Cl. ..... 81/63.1; 81/60; 81/438

[58] Field of Search ..... 81/63.1, 63.2, 81/60, 438, 439

[56] References Cited

U.S. PATENT DOCUMENTS

| | | | |
|---|---|---|---|
| 1,961,246 | 6/1934 | Powers | 81/439 |
| 2,158,728 | 5/1939 | Peters | 81/439 |
| 2,527,492 | 10/1950 | Cleary et al. | 81/438 |
| 4,776,246 | 10/1988 | Elliston | 81/438 |
| 5,570,616 | 11/1996 | Thompson et al. | 81/63.1 |
| 5,573,093 | 11/1996 | Lee | 192/43.2 |
| 5,651,294 | 7/1997 | Shiao | 81/59.1 |
| 5,687,820 | 11/1997 | Lin | 192/43.2 |
| 5,732,606 | 3/1998 | Chiang | 81/177.2 |
| 5,894,765 | 4/1999 | Anderson et al. | 81/60 |
| 5,901,622 | 5/1999 | Sweeny | 81/439 |
| 5,974,915 | 11/1999 | Chou | 81/63.1 |
| 6,047,617 | 4/2000 | Chen | 81/63.1 |

*Primary Examiner*—James G. Smith
*Assistant Examiner*—Hadi Shakeri
*Attorney, Agent, or Firm*—Charles E. Baxley

[57] ABSTRACT

A ratchet screw driver includes a barrel having a stud en gaged into a handle and having a pair of opposite passages for slidably receiving a pair of pawls. A gear is rotatably received in the barrel and has an aperture for receiving various kinds of driving stems. A spring is engaged on the barrel and has two end beads engaged with the pawls for biasing the pawls to engage with the gear. The barrel includes a curved slot for receiving an actuator which is engaged into the curved slot of the barrel and located between the pawls for moving the pawls against the spring.

10 Claims, 5 Drawing Sheets

RATCHET SCREW DRIVER

BACKGROUND OF THE INVENTION

1. Field of the Invention

The present invention relates to a screw driver, and more particularly to a ratchet screw driver.

2. Description of the Prior Art

A typical ratchet screw driver is disclosed in U.S. Pat. No. 5,687,820 to Lin and includes a driving stem that is secured to the handle and may not be easily disengaged from the handle for being replaced with the other driving stems of different configurations or sizes.

The applicant has developed an extendible screw driver which is disclosed in U.S. Pat. No. 5,732,606 to Chiang and which includes a flexible extension that may be extended outward of the handle for increasing the length of the driving stem. However, no ratchet mechanism is applied to the screw driver and the driving stem also may not be disengaged from the handle for being replaced with the other driving stems.

The present invention has arisen to mitigate and/or obviate the afore-described disadvantages of the conventional screw drivers

SUMMARY OF THE INVENTION

The primary objective of the present invention is to provide a ratchet screw driver including a structure for allowing the driving stems to be changeably engaged with the screw driver handle.

In accordance with one aspect of the invention, there is provided a ratchet screw driver comprising a handle including a bore formed therein and including a first end having an engaging opening formed therein and communicating with the bore of the handle, a barrel including a stud extended therefrom and engaged into the engaging opening of the handle and moved in concert with the handle, the barrel including an orifice formed therein and communicating wit h the bore of the handle when the stud of the barrel is engaged into the engaging opening of the handle, the barrel including a pair of opposite passages formed therein and communicating with the orifice of the barrel, a gear rotatably received in the orifice of the barrel and including an aperture formed therein, a pair of pawls slidably received in the passages of the barrel for engaging with the gear, at least one driving stem selectively engaged into the bore of the handle through the aperture of the gear and the orifice of the barrel, means for biasing the pawls to engage with the gear, and means for selectively disengaging the pawls from the gear. Various kinds of driving stems may be selectively engaged into the gear and the barrel.

The aperture of the gear includes a non-circular cross section for receiving the driving stem having a corresponding non-circular cross section, the gear includes at least one notch communicating with the aperture of the gear, the driving stem has at least one flange for engaging into the notch of the gear.

The biasing means includes a biasing member having two ends engaged into the passages of the barrel and engaged with the pawls for biasing the pawls to engage with the gear. The barrel includes an outer peripheral portion having an annular groove for receiving the biasing member. A fastener is further provided for securing the middle portion of the biasing member to the barrel. The ends of the biasing member each includes a bead for engaging with the pawls.

The barrel includes a curved slot communicating with the orifice. An actuator is engaged into the curved slot of the barrel and located between the pawls for moving the pawls against the biasing means.

A control ferrule is rotatable engaged onto the barrel, the actuator is extended from the control ferrule and moved against the pawls by the control ferrule. A positioning device is further provided for positioning the control ferrule to the barrel. The barrel includes three cavities, the control ferrule includes a spring-biased projection engaged with either of the cavities of the barrel for positioning the control ferrule to the barrel.

A flexible extension may further be extendibly and slidably received in the driving stem for extending the driving length of the ratchet screw driver.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
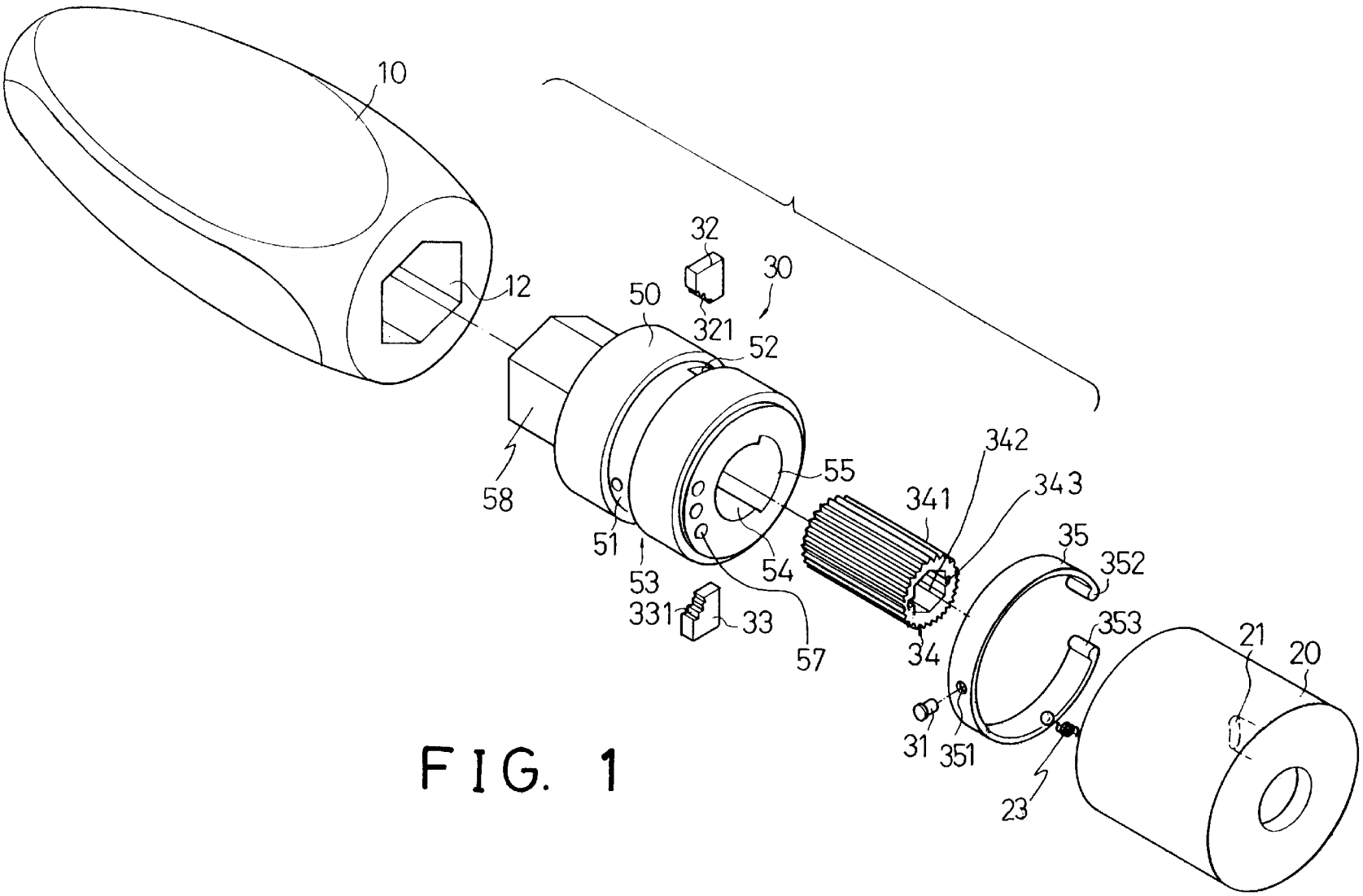
FIG. 1 is an exploded view of a screw driver in accordance with the present invention.
Figure 2:
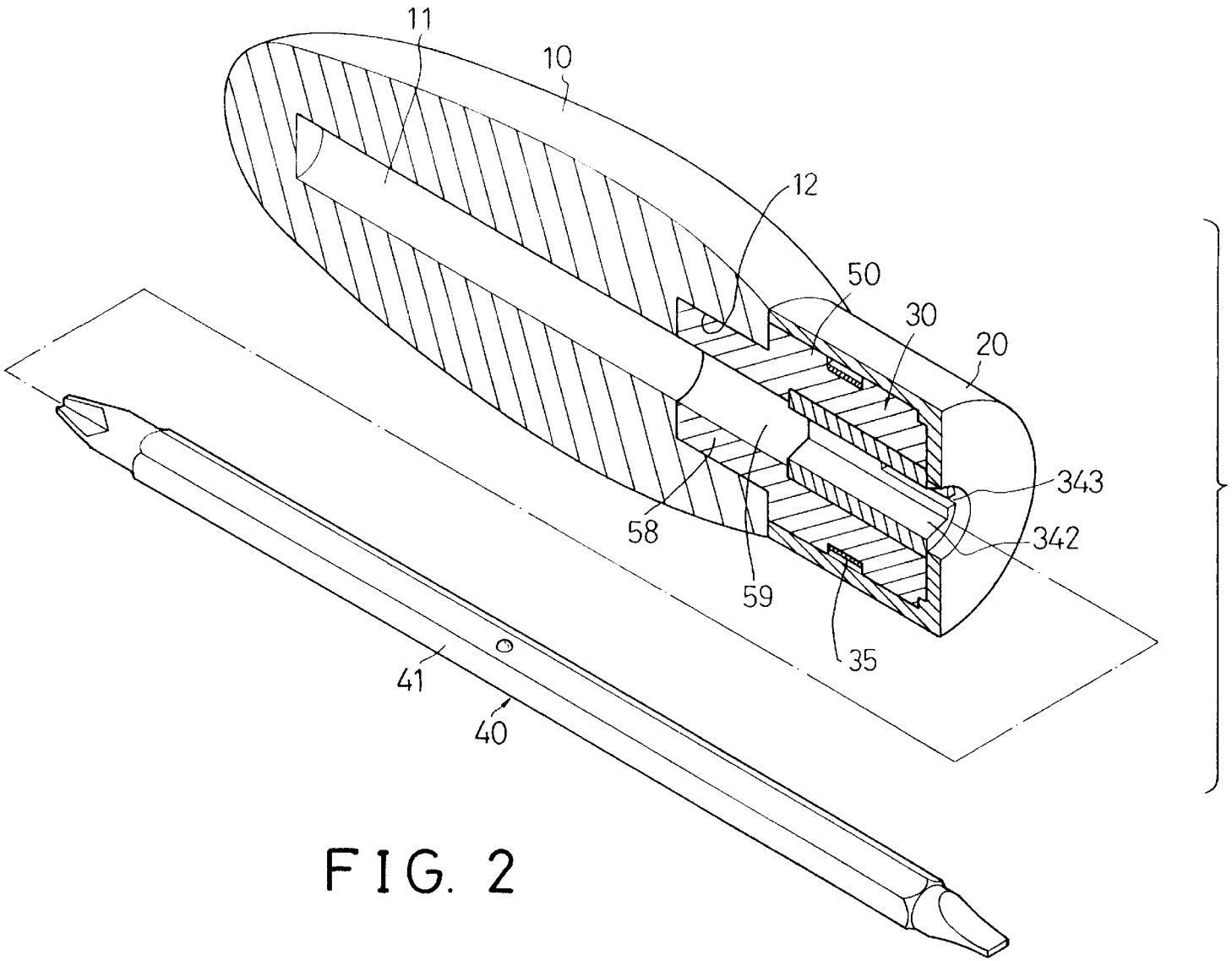
FIG. 2 is an exploded view of the screw driver and a driving stem that may be selectively and changeably engaged into the screw driver.

Referring to the drawings, and initially to FIGS. 1 and 2, a ratchet screw driver in accordance with the present invention comprises a handle 10 including a bore 11 formed therein and including an engaging opening 12 formed in one end thereof and communicating with the bore 11 and having a non-circular cross section, particularly the hexagonal cross section. A ratchet tool cartridge 30 includes a barrel 50 having a stud 58 extended from one end thereof and engaged into the engaging opening 17 of the handle 10. The stud 58 includes a non-circular cross section, particularly the hexagonal cross section, for engaging with the corresponding cross section of the engaging opening 12 of the handle 10, by such as a force-fitted engagement, and for allowing the stud 58 and the barrel 50 to be secured to the handle 10 and rotated in concert with the handle 10. The stud 58 may also be secured to the handle 10 with a key device.

Figure 3:
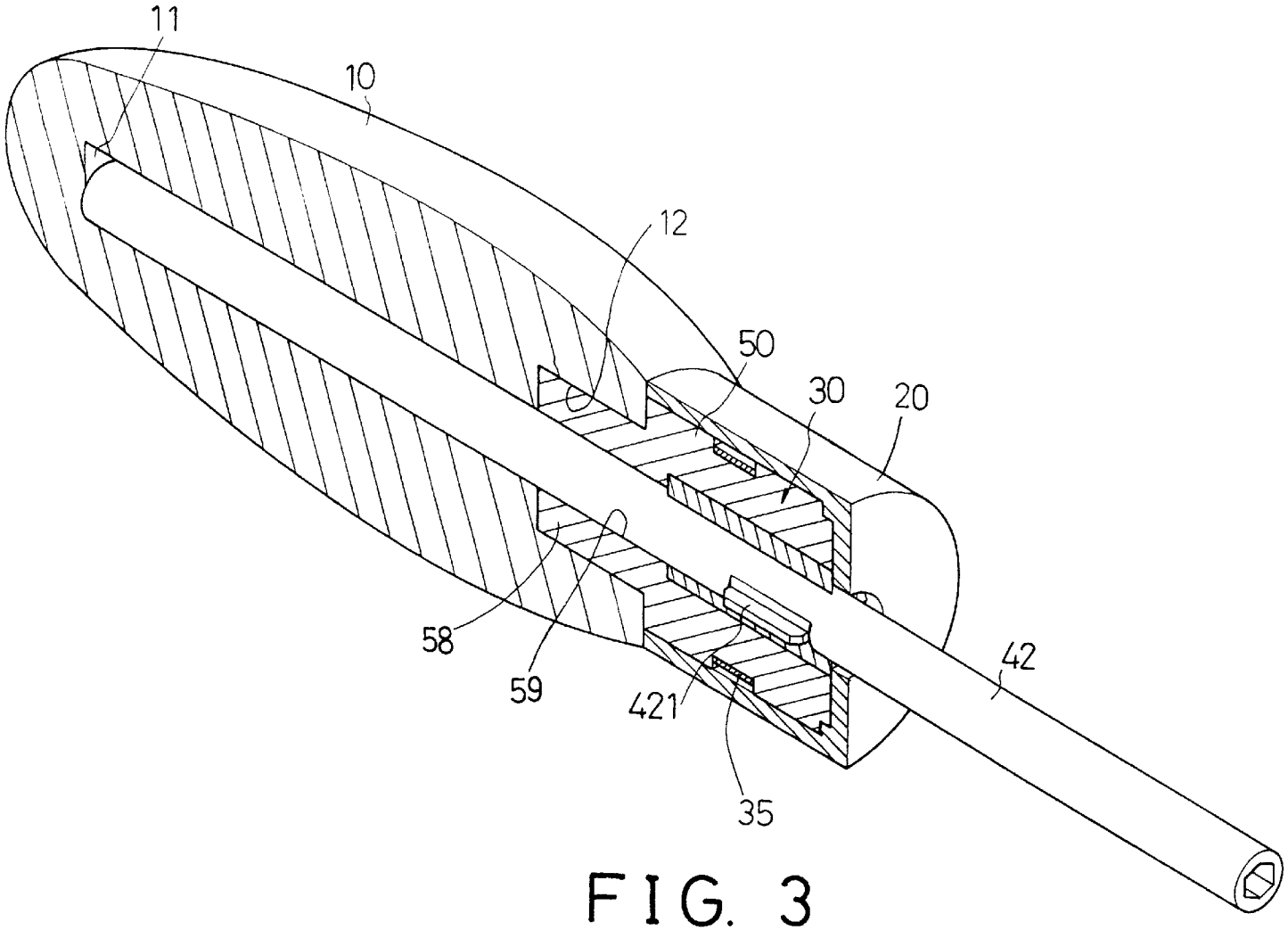
FIG. 3 is a perspective view of the screw driver, in which one half of the screw driver is cut off for showing the inner structure of the screw driver.
Figure 4:
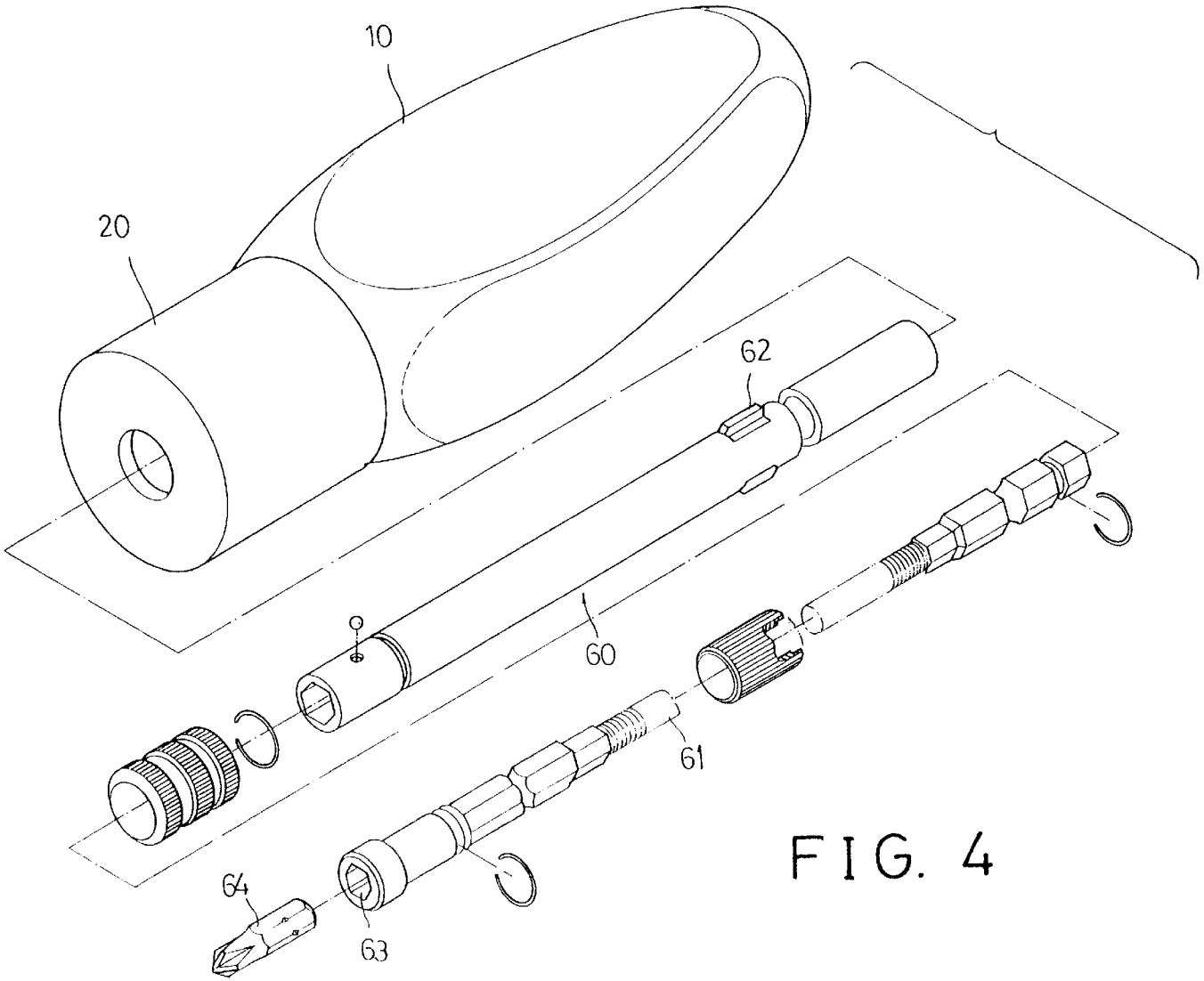
FIG. 4 is an exploded view illustrating the application of the screw driver.
Figure 5:
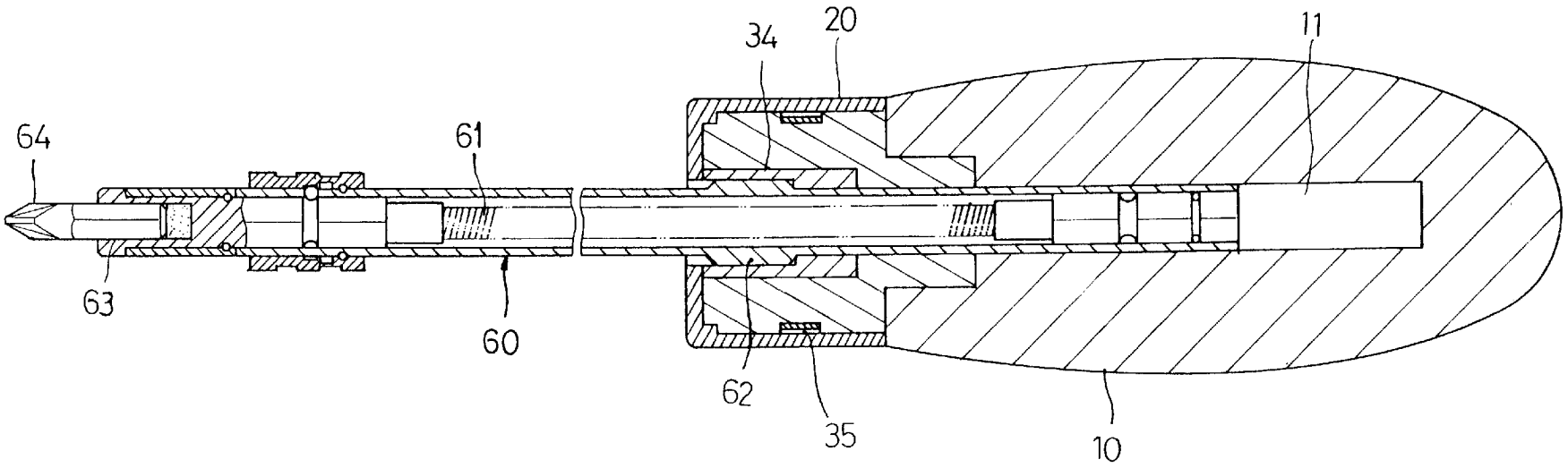
FIG. 5 is a cross sectional view of the screw driver as shown in FIG. 4.

The barrel 50 includes an orifice 54 formed therein and facing away from the stud 58 for rotatably receiving a gear, particularly a ratchet gear 34 therein. The gear 34 includes a number of teeth 341 formed on the outer peripheral portion thereof and includes an aperture 342 formed therein for receiving a driving stem 40 (FIG. 2) or 42 (FIG. 3) or 60 (FIGS. 4, 5). The aperture 342 of the gear 34 includes a non-circular cross section, particularly the hexagonal cross section, for engaging with the corresponding non-circular or hexagonal cross section 41 of the driving stem 40, and for allowing the driving stem 40 to be secured to the gear 34 and rotated in concert with the gear 34. The inner portion 59 (FIGS. 2, 3) of the orifice 54 of the barrel 50 includes a circular cross section having a size smaller than that of the orifice 54 of the barrel 50 for forming a shoulder therein and for stably retaining the gear 34 in place. The driving stems 40, 42, 60 may be engaged into the bore 11 of the handle 10 via the inner portion 59 of the orifice 54 of the barrel 50. The gear 34 may further includes one or more notches 343 formed therein for receiving the flanges 421 or 62 of the driving stems 42 (FIG. 3) or 60 (FIGS. 4, 5), for allowing the driving stems 42, 60 of a circular cross section to be secured to the gear 34 and to be rotated in concert with the gear 34. Various kinds of driving stems 40, 42, 60 may thus be replaceably or changeably engaged into the gear 34.

The barrel 50 includes a passage or a pair of opposite passages 52, 53 formed therein and communicating with the orifice 54 of the barrel 50 for slidably receiving a pair of pawls 32, 33 each of Which includes one or more teeth 321, 331 for engaging with the teeth 341 of the gear 34 and for controlling the driving directions of the gear 34 and thus the driving stems 40, 42, 60 by the barrel 50 and the handle 10. One example of the engagement of the pawls 32, 33 with the gear 34 has been disclosed in U.S. Pat. No. 5,687,820 to Lin which is thus taken as a reference for the present invention. The barrel 50 includes an annular groove 51 formed in the outer peripheral portion thereof for receiving a C-shaped resilient or biasing member 35. The biasing member 35 includes a hole 351 formed in the middle portion thereof for receiving a fastener 31, such as a screw or a rivet or the like, which is engaged into the barrel 50 for securing the middle portion of the biasing member 35 to the barrel 50. The biasing member 35 includes two ends each having a bead 352, 353 formed thereon and engaged into the passages 52, 53 of the barrel 50 and engaged with the pawls 32, 33 for biasing the pawls 32, 33 to engage with the gear 34. The provision of the bead 352, 353 to engage with the pawls 32, 33 is to prevent the pawls 32, 30 from being damaged by the ends of the biasing member 35.

The barrel 50 further includes a curved slot 55 (FIG. 1) formed therein and formed beside the orifice 54 thereof and communicating with the orifice 54 and the passages 52, 53 thereof. A cover or a control ferrule 20 is rotatably engaged onto the barrel 50 and preferably covers the biasing member 35 (FIGS. 2, 3, 5) for shielding and preventing the biasing member 35 from being damaged or from hurting the users. The control ferrule 20 includes an actuator 21 extended inward therefrom and extended inward of the slot 55 of the barrel 50 and located between the pawls 32, 33 for actuating or for moving the pawls 32, 33 against the biasing member 35. The control ferrule 20 includes a spring-biased projection 23 provided therein for engaging with either of three cavities 57 of the barrel 50 and for positioning the control ferrule 20 to the barrel 50 at three relative positions where the actuator 91 moves either of the pawls 32, 33 against the biasing member 35 or where the actuator 21 is located between the pawls 32, 33 and do not act onto the pawls 32, 33.

Referring next to FIGS. 4 and 5, a flexible extension 61 may further be provided and slidably engaged in the driving stem 60 and may include an engaging opening 63 formed in one end thereof for receiving the tool bits 64, for example. The flexible extension 61 and the corresponding configuration thereof has been disclosed in the applicant's prior U.S. Pat. No. 5,732,606 to Chiang which is also taken as a reference for the present invention.

Accordingly, the ratchet screw driver in accordance with the present invention includes a structure for allowing various kinds of driving stems to be changeably engaged with the screw driver handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet screw driver comprising:

a handle including a bore formed therein and including a first end having an engaging opening formed therein and communicating with said bore of said handle, a barrel including a stud extended therefrom and engaged into said engaging opening of said handle and moved in concert with said handle, said barrel including an orifice formed therein and communicating with said bore of said handle when said stud of said barrel is engaged into said engaging opening of said handle, said barrel including a pair of opposite passages formed therein and communicating with said orifice of said barrel, a gear rotatably received in said orifice of said barrel and including an aperture formed therein, a pair of pawls slidably received in said passages of said barrel for engaging with said gear, at least one driving stem selectively engaged into said bore of said handle through said aperture of said gear and said orifice of said barrel, means for biasing said pawls to engage with said gear and means for selectively disengaging said pawls from said gear, said at least one driving stem being allowed to be disengaged from said gear and said barrel, wherein said biasing means includes a biasing member engaged on said barrel and having two ends engaged into said passages of said barrel and engaged with said pawls for biasing said pawls to engage with said gear.

2. The ratchet screw driver according to claim 1 wherein said aperture of said gear includes a non-circular cross section for receiving said at least one driving stem having a corresponding non-circular cross section, said gear further includes at least one notch formed therein and communicating with said aperture of said gear, said at least one driving stem including at least one flange extended therefrom for engaging into said at least one notch of said gear.

3. The ratchet screw driver according to claim 1, wherein said barrel includes an outer peripheral portion having an annular groove formed therein for receiving said biasing member.

4. The ratchet screw driver according to claim 1, wherein said biasing member includes a middle portion, said biasing means includes means for securing said middle portion of said biasing member to said barrel.

5. The ratchet screw driver according to claim 1, wherein said ends of said biasing member each includes a bead formed thereon for engaging with said pawls.

6. A ratchet screw driver comprising:

a handle including a bore formed therein and including a first end having an engaging opening formed therein and communicating with said bore of said handle, a barrel including a stud extended therefrom and engaged into said engaging of said handle and moved in concert with said handle, said barrel including an orifice formed therein and communicating with said bore of said handle when said stud of said barrel is engaged into said engaging opening of said handle, said barrel including a pair of opposite passages formed therein and communicating with said orifice of said barrel, a gear rotatably received in said orifice of said barrel and including aperture formed therein, a pair of pawls slidably received in said passages of said barrel for engaging with said gear, at least one driving stem selectively engaged into said bore of said handle through said aperture of said gear and said orifice of said barrel, means for biasing said pawls to engage with said gear, and means for selectively disengaging said pawls from said gear, said at least one driving stem being allowed to be disengaged from said gear and said barrel, wherein said barrel includes a curved slot formed beside said orifice thereof and communicating with said orifice thereof, said selectively disengaging means for said pawls includes an actuator engaged into said curved slot of said barrel and located between said pawls for moving said pawls against said biasing means.

7. The ratchet screw driver according to claim 6, wherein said selectively disengaging means for said pawls includes a control ferrule rotatably engaged onto said barrel, said actuator is extended from said control ferrule and moved against said pawls by said control ferrule.

8. The ratchet screw driver according to claim 7 further comprising means for positioning said control ferrule to said barrel.

9. The ratchet screw driver according to claim 7, wherein said barrel includes three cavities formed therein, said control ferrule includes a spring-biased projection received therein and engaged with either of said cavities of said barrel for positioning said control ferrule to said barrel.

10. The ratchet screw driver according to claim 1 further comprising a flexible extension slidably received in said at least one driving stem and extendible outward of said at least one driving stem for extending a driving length of said ratchet screw driver.

* * * * *